US012152794B2

(12) United States Patent
Mills et al.

(10) Patent No.: US 12,152,794 B2
(45) Date of Patent: Nov. 26, 2024

(54) APPARATUS AND METHOD FOR PROVIDING A SELECTIVE FILTERED FRESH AIR SOURCE USING NEW OR EXISTING DUCTING

(71) Applicant: CentraVent, LLC, Cameron Park, CA (US)

(72) Inventors: Kirk Mills, Rancho Cordova, CA (US); Kimberley Mills, Rancho Cordova, CA (US)

(73) Assignee: CentraVent, LLC, Cameron Park, CA (US)

( * ) Notice: Subject to any disclaimer, the term of this patent is extended or adjusted under 35 U.S.C. 154(b) by 378 days.

(21) Appl. No.: 17/855,070

(22) Filed: Jun. 30, 2022

(65) Prior Publication Data

US 2023/0184449 A1 Jun. 15, 2023

Related U.S. Application Data

(60) Provisional application No. 63/289,770, filed on Dec. 15, 2021.

(51) Int. Cl.
*F24F 11/00* (2018.01)
*F24F 11/77* (2018.01)

(52) U.S. Cl.
CPC ..... *F24F 11/0001* (2013.01); *F24F 11/77* (2018.01)

(58) Field of Classification Search
CPC ..... F24F 11/0001; F24F 11/77; F24F 7/02
See application file for complete search history.

(56) References Cited

U.S. PATENT DOCUMENTS 1,924,489 A 8/1933 Ferris
1,931,156 A 10/1933 Persons
(Continued)

FOREIGN PATENT DOCUMENTS

WO WO/1996/023152 8/1996
WO WO/2005/071324 8/2005
(Continued)

OTHER PUBLICATIONS

Field Controls, LLC, Fresh Air Systems webpages, http://www.fieldcontrols.com (Jul. 3, 2018).

*Primary Examiner* — Mohammad Ali
*Assistant Examiner* — Vincent W Chang
(74) *Attorney, Agent, or Firm* — Inventive Law Inc.; Jim H. Salter

(57) ABSTRACT

An apparatus and method for providing a selective fresh air source using existing ducting is disclosed. An example embodiment includes: Installing a CVT CB; coupling an optional Wi-Fi wall switch, coupling a CVT App, installing a fresh outside air low-profile roof vent coupled to the flex duct; coupling a flex duct coupled to an optional duct damper; coupling an optional actuator coupled to the optional duct damper; coupling an optional duct damper to a flex duct; coupling a flex duct coupled to a round to rectangle sheet metal duct collar; coupling a round to rectangle sheet metal duct collar coupled to an optional UV light; coupling a round to rectangle sheet metal duct collar coupled to the filter box; coupling a filter box to the "L" shaped or standard transition box set between the existing HVAC furnace/air handler/evaporative coil and the existing HVAC plenum; coupling a "L" shaped or standard transition box coupled to a dual position rolling, flag or other type of damper; coupling a rolling, flag or other type of damper to a rolling or other type of damper actuator; coupling rolling actuator or other type of actuator to the CVT CB (or if
(Continued)

connecting to a whole house fan other than the CVT WHF couple to the CVT Wi-Fi PNP); coupling a CO/Refrigerant gas detector within the transition box, leading to the existing HVAC supply plenum with plurality existing HVAC supply ducts and plurality of existing output supply vents having access to air inside of the structure. The filtered fresh air can now be pulled through the CVT WHF or existing whole house fan to cool off the home/structure and flush the attic air.

30 Claims, 8 Drawing Sheets

(56) References Cited

U.S. PATENT DOCUMENTS

| | | | | |
|---|---|---|---|---|
| 2,278,581 | A | 4/1942 | Macdougald | |
| 2,349,627 | A | 5/1944 | Kemmer | |
| 2,483,377 | A | 9/1949 | Young | |
| 2,612,831 | A | 10/1952 | Lohman, Jr. | |
| 2,668,491 | A | 2/1954 | Gerlitz | |
| 2,875,678 | A | 3/1959 | Wyley | |
| 3,727,424 | A | 4/1973 | Edens | |
| 3,792,593 | A | 2/1974 | Loos | |
| 4,018,266 | A | 4/1977 | Kay | |
| 4,261,255 | A | 4/1981 | Anderson | |
| 4,375,183 | A | 3/1983 | Lynch | |
| 4,385,550 | A | 5/1983 | Steiner | |
| 4,416,415 | A | 11/1983 | Kolt | |
| 4,501,194 | A | 2/1985 | Brown | |
| 4,501,389 | A | 2/1985 | Kolt | |
| 4,510,851 | A | 4/1985 | Samosky | |
| 4,594,940 | A | 6/1986 | Wolbrink | |
| 4,596,180 | A | 6/1986 | Steiner | |
| 4,628,802 | A | 12/1986 | Steiner | |
| 4,766,806 | A | 8/1988 | Tomiser, Jr. | |
| 4,779,518 | A | 10/1988 | Artwick | |
| 4,784,049 | A | 11/1988 | Steiner | |
| 4,939,986 | A | 7/1990 | Turner | |
| 5,060,901 | A | 10/1991 | Lathrop | |
| 5,065,585 | A | 11/1991 | Wylie | |
| 5,741,180 | A | 4/1998 | Xia | |
| 5,881,806 | A | 3/1999 | Rudd | |
| 5,989,119 | A | 11/1999 | Raisanen | |
| 6,071,189 | A | 6/2000 | Blalock | |
| 6,514,138 | B2 * | 2/2003 | Estepp | F24F 11/745 454/236 |
| 6,533,656 | B2 | 3/2003 | Hertel | |
| 6,749,125 | B1 | 6/2004 | Carson | |
| 6,752,713 | B2 | 6/2004 | Johnson, Jr. | |
| 6,802,770 | B2 | 10/2004 | Larson | |
| 6,979,169 | B2 | 12/2005 | Penlesky | |
| 7,044,397 | B2 | 5/2006 | Bartlett | |
| 7,128,303 | B2 | 10/2006 | Penlesky | |
| 7,284,382 | B2 | 10/2007 | Wong | |
| 7,398,821 | B2 | 7/2008 | Rainer | |
| 7,455,500 | B2 | 11/2008 | Penlesky | |
| 7,475,828 | B2 | 1/2009 | Bartlett | |
| 7,497,774 | B2 | 3/2009 | Stevenson | |
| 7,731,477 | B2 | 6/2010 | Erni | |
| 7,774,102 | B2 | 8/2010 | Butler | |
| 8,165,719 | B2 | 4/2012 | Kinney | |
| 8,543,244 | B2 | 9/2013 | Keeling | |
| 8,550,368 | B2 | 10/2013 | Butler | |
| 8,562,283 | B2 | 10/2013 | Hopkins | |
| 8,564,148 | B1 | 10/2013 | Novak | |
| 8,791,587 | B2 | 7/2014 | Smith, Jr. | |
| 9,261,290 | B2 | 2/2016 | Storm | |
| 9,322,568 | B2 | 4/2016 | Aycock | |
| 9,338,810 | B2 | 5/2016 | Erickson | |
| 9,383,115 | B2 | 7/2016 | Siegel | |
| 9,796,239 | B2 | 10/2017 | Connell | |
| 9,874,362 | B2 * | 1/2018 | Douglas | F24F 11/0001 |
| 10,072,860 | B2 | 9/2018 | Richards | |
| 10,619,872 | B2 | 4/2020 | Mills | |
| 10,760,802 | B2 | 9/2020 | Mills | |
| 11,092,350 | B1 | 8/2021 | Stevenson | |
| 11,193,687 | B2 | 12/2021 | Stevenson | |
| 11,274,839 | B1 | 3/2022 | Stevenson | |
| 2002/0112409 | A1 | 8/2002 | Knowles | |
| 2005/0076655 | A1 | 4/2005 | Wong | |
| 2005/0156052 | A1 | 7/2005 | Bartlett | |
| 2006/0154596 | A1 * | 7/2006 | Meneely, Jr. | F24F 11/77 454/239 |
| 2006/0158051 | A1 | 7/2006 | Bartlett | |
| 2007/0145160 | A1 | 6/2007 | Martin | |
| 2008/0096482 | A1 | 4/2008 | Wettergren | |
| 2009/0013703 | A1 | 1/2009 | Werner | |
| 2009/0186570 | A1 | 7/2009 | Riggins | |
| 2011/0151766 | A1 | 6/2011 | Sherman | |
| 2011/0223850 | A1 | 9/2011 | Narayanamurthy | |
| 2013/0166075 | A1 | 6/2013 | Castillo | |
| 2013/0180700 | A1 | 7/2013 | Aycock | |
| 2013/0244563 | A1 | 9/2013 | Noteboom | |
| 2014/0206278 | A1 | 7/2014 | Stevenson | |
| 2014/0242898 | A1 | 8/2014 | Richards | |
| 2014/0333072 | A1 | 11/2014 | Smith | |
| 2016/0054016 | A1 | 2/2016 | Takahashi | |
| 2016/0097553 | A1 * | 4/2016 | Brian | F24F 11/0001 454/255 |
| 2020/0011555 | A1 | 1/2020 | Mills | |
| 2020/0256571 | A1 * | 8/2020 | Johnson, Jr. | F24F 11/62 |
| 2020/0333036 | A1 | 10/2020 | Patel | |
| 2021/0156582 | A1 | 5/2021 | Stevenson | |
| 2021/0231325 | A1 | 7/2021 | Stevenson | |
| 2021/0348791 | A1 | 11/2021 | Stevenson | |
| 2022/0082285 | A1 | 3/2022 | Stevenson | |
| 2022/0196265 | A1 | 6/2022 | Stevenson | |
| 2022/0412596 | A1 * | 12/2022 | Ross | F24F 3/0442 |
| 2023/0417446 | A1 * | 12/2023 | Baldwin | G05B 19/0423 |

FOREIGN PATENT DOCUMENTS

| | | |
|---|---|---|
| WO | WO/2012/048184 | 4/2012 |
| WO | WO/2018/018989 | 2/2018 |
| WO | WO/2021/102022 | 5/2021 |
| WO | WO/2022/017335 | 1/2022 |

* cited by examiner

APPARATUS AND METHOD FOR PROVIDING A SELECTIVE FILTERED FRESH AIR SOURCE USING NEW OR EXISTING DUCTING

PRIORITY PATENT APPLICATION

This non-provisional patent application draws priority from U.S. provisional patent application Ser. No. 63/289,770; filed Dec. 15, 2021. This present non-provisional patent application draws priority from the referenced patent application. The entire disclosure of the referenced patent application is considered part of the disclosure of the present application and is hereby incorporated by reference herein in its entirety.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure provided herein and to the drawings that form a part of this document: Copyright 2019-2022, CentraVent, LLC; All Rights Reserved.

TECHNICAL FIELD

The disclosed subject matter relates to the field of heating, cooling, ventilating, and Carbon Monoxide (CO)/Refrigerant Gas detection equipment for structures, and particularly although not exclusively, to an apparatus and method for providing a selective filtered fresh air source using existing ducting, along with operations to seal and power off existing Heating, Ventilating, and Air Conditioning (HVAC) equipment if CO/Refrigerant Gas is detected and flush the structure with filtered fresh air.

BACKGROUND

Heating and cooling the space in residential and commercial buildings accounts for a primary share of building energy consumption. Existing buildings use either an air conditioning system or a whole house fan for cooling and ventilating residential and commercial building structures. Traditional air conditioning systems function by altering the temperature and humidity of the air and then pumping the treated air throughout the structure. The thermostat powers on the air conditioner until the structure reaches a set point temperature. While effective at conditioning the air, such traditional air conditioning systems are costly to run and not energy efficient. Additionally, when the outside ambient air temperature is lower than the internal air temperature, outside ambient air could instead be used to effectively cool the structure, reducing the need to run a costly air conditioning system. Further, air conditioning systems merely circulate air located within a building, and do not bring any outside air, so any harmful environmental elements (e.g. dust, disease, CO/Refrigerant gas, chemicals, etc.) remain within the building.

In response to such problems, some structures instead use whole house fans to force air through the structure. Whole house fans consist of one or more exhaust fans, typically placed in the attic or an upper floor, and function by creating a negative pressure inside of the structure to draw cooler air in from the outside. The cooler outside air is forced up through the ceiling into the attic where the air is exhausted out through a vent. Louvered shutters are often placed over the vent to prevent cooled or heated air from escaping when the fan is not in use. However, these louvers do not fully prevent the air, insulation or debris from entering the home. Whole house systems move large amounts of air and allow for the entire structure air volume to be recycled with multiple air exchanges per hour, removing latent heat within the structure. Traditional whole house fans are installed on the attic floor such that they directly contact the ceiling of the structure. As such, the large capacity whole house fans, necessary to create sufficient negative pressure to draw the cooler air inside in the structure, can create undesirable noise and vibrations that penetrate the occupied space of the building. Advantageously, these systems require less energy than air conditioning systems and can reduce the need for air conditioning and therefore reduce structure energy consumption while still providing a comfortable space. However, such whole house fans require open windows or doors to serve as intake air vents. Thus, the user is required to manually control the air flow. The opened windows or doors, however, can allow in dust, pollen, and other pollutants from the exterior incoming air. The opened windows or doors can also create security problems for the owner. There are also many CO/Refrigerant detectors on the market today that will alert the user of the detection of poisonous gas; however, none of them are linked with the HVAC allowing them to shut off the source of the leak and flush the structure with fresh filtered air. Thus, a better whole house fan, fresh air system is needed that does not require open windows or doors.

SUMMARY

As disclosed herein, the term CVT WHF refers to a Central Ventilation and Whole House Fan system, which is disclosed and claimed in various embodiments in U.S. Pat. No. 10,619,872, and designated in the figures included herewith with reference number 148. As disclosed herein, the term CVT FFC refers to a Central Ventilation and Filtered Free Cooling system, which is disclosed and claimed in various embodiments in U.S. Pat. No. 10,760,802. As disclosed herein, the term CVT CB refers to a Central Ventilation and Control Board system, which is designated in the figures included herewith with reference number 145. As disclosed herein, the term CVT App refers to a Central Ventilation and Software Application system, which is designated in the figures included herewith with reference number 160. As disclosed herein, the term CVT Wi-Fi PNP refers to a Central Ventilation Wi-Fi Plug-n-Play plug adaptor, which is designated in the figures herein with reference number 153.

According to various example embodiments of the disclosed subject matter as described herein, there is disclosed, illustrated, and claimed an apparatus and method for providing a selective fresh air source using existing ducting, along with operations to seal and power off existing HVAC equipment if CO/Refrigerant Gas is detected and flush the structure with fresh filtered air. The example embodiments disclosed herein provide an apparatus, system, and method implemented as a Filtered Fresh Air System. Example embodiments of the disclosed Filtered Fresh Air System 100 can utilize the existing HVAC (heating, ventilating, and air conditioning) supply vents in the ceiling or floors to access outdoor fresh filtered air for a whole house fan, thereby eliminating the need to open a door or window for fresh air. Additionally, for indoor environmental safety measures, a Carbon Monoxide/Refrigerant gas detector is mounted in the transition box. If CO or Refrigerant gas is detected, a signal is sent to the CVT CB 145 and CVT App 160, immediately shutting off the existing HVAC Furnace/Air Handler system and turning on the fresh air system. This will damper off the existing HVAC Furnace/Air Handler and evaporative coil, open the dampers to the outside filtered fresh air, and turn on the whole house fan, flushing out the interior of the structure. The CVT App 160 will prompt the user to alert emergency services, keeping the occupants of the structure safe and eliminating the threat of CO or Refrigerant gas poisoning. The CVT App 160 will also prompt the user to contact a service technician to advise them of the alert.

The Filtered Fresh Air System 100 of various example embodiments can be equipped with three separate air dampers that can be installed between the existing HVAC, Furnace, Evaporative coil, and the existing HVAC air supply plenum, also in the ducting leading to the outside air intake. The air damper types mentioned in the embodiments are; a dual position rolling damper, a dual position flag damper and an optional round duct damper however, there are many known and unknown dampers that could also work to accomplish the same goal of sealing off or dampening off the specific openings. The Filtered Fresh Air System of an example embodiment can utilize the existing supply plenum and supply ducting of a standard HVAC system to distribute filtered fresh outdoor air throughout a building space using the air ducting already installed in the building, along with a CO/Refrigerant gas detector. The complete system communicates with the CVT CB 145 and the CVT App 160. The Filtered Fresh Air System 100 of an example embodiment can work in conjunction with most whole house fan systems on the market today. If installing with an existing whole house fan (other than the CVT WHF 148), the existing whole house fan will need to be plugged into the CVT Wi-Fi PNP in order to gain access to the CVT App 160. Optimally, the Filtered Fresh Air System 100 should be installed with a CVT WHF 148, to access all features. Example embodiments are described in more detail below.

BRIEF DESCRIPTION OF THE DRAWINGS

Embodiments are illustrated by way of example and not limitation in the figures of the accompanying drawings, in which.

DETAILED DESCRIPTION

Figure 1:
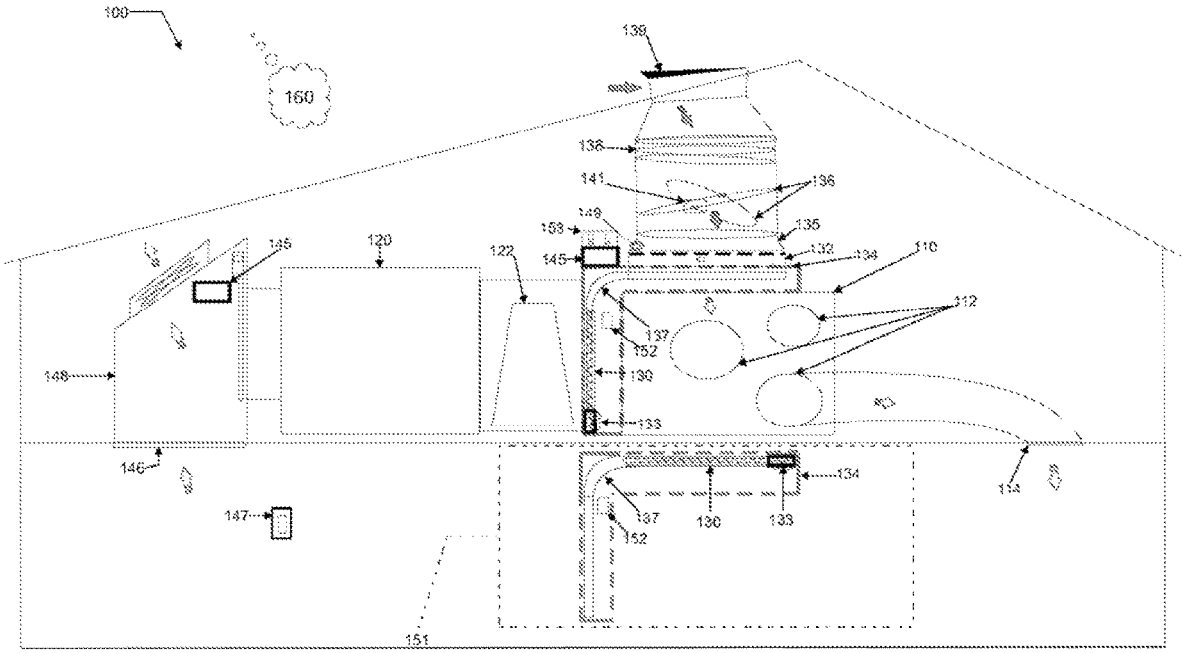
FIG. 1 illustrates an example embodiment with an "L" shaped transition box with a rolling damper between the existing HVAC evaporative coil and the existing HVAC plenum supply box.

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is disclosed, illustrated, and claimed an apparatus and method for providing a selective filtered fresh air source using existing ducting, along with operations to seal and power off existing HVAC equipment while the Filtered Fresh Air System 100 is running. The Filtered Fresh Air System 100 will also have the ability to automatically turn on the CVT WHF 148 or existing whole house fan and at the same time seal and power off existing HVAC equipment if CO/Refrigerant Gas is detected, then flush the structure with filtered fresh air. The Filtered Fresh Air System 100 of example embodiments disclosed herein provide an apparatus, system, and method implemented as a filtered fresh air system. Example embodiments of the disclosed Filtered Fresh Air System 100 can utilize the existing HVAC (heating, ventilating, and air conditioning) supply vents in the ceiling or floors to access outdoor filtered fresh air for a whole house fan, thereby eliminating the need to open a door or window for fresh air while the whole house fan is running. The CVT CB 145 and the CVT App 160 can communicate with an existing thermostat or smart thermostat in the structure to give operation choices or updates to the user. The CVT CB 145 is configured to work with the example embodiments filtered fresh air system, the CVT WHF 148, the CVT App 160, and CVT FFC. If the Filtered Fresh Air System 100 is installed with a whole house fan other than the CVT WHF 148, then it will connect to the CVT CB 145 and the Non-CVT WHF will connect to the CVT Wi-Fi PNP 153. This CVT Wi-Fi PNP 153 allows access to the CVT App 160 with limited functionality.

The CVT CB 145 has software and safeties that protect the existing HVAC/furnace/evaporative coil system, preventing the HVAC/furnace from running at the same time as the whole house fan and filtered fresh air system. The CVT App 160 can communicate with the CVT CB 145, the CVT Wi-Fi Wall Switch 147, the CVT Wi-Fi PNP 153 and smart thermostats to set schedules, read outdoor and indoor temperatures to determine if and when it is energy efficient to run. It can control the speed of the CVT WHF 148. When using the CVT Wi-Fi PNP 153 (due to connecting to an existing whole house fan other than the CVT WHF 148), the CVT App 160 will have limited functions and will not control the speed of some existing whole house fan motors. It can show the user charts or statistics of energy consumption along with checking the indoor air quality.

A CO/Refrigerant gas detector is coupled to the transition box, which communicates with the CVT CB 145 and the CVT App 160. If it detects CO or Refrigerant gas in the transition box or plenum, a signal will be sent to the CVT CB 145 and the CVT App 160. Then the filtered fresh air system and the CVT WHF 148 or existing whole house fan, will turn both on immediately, which will seal and power off the existing HVAC/furnace/evaporative coil, isolating the threat until a repair or alert is cleared. The CVT App 160 will alert the user and will prompt the user with an option to contact emergency services and or a service company to respond to the alert. These Internet of Things (IOT) features will learn and operate automatically or manually, while giving updates and information to the user.

The Filtered Fresh Air System 100 of various example embodiments can be equipped with two separate air dampers. One that can be installed between the existing HVAC evaporative coil and existing HVAC air supply plenum, to access the existing HVAC air supply vents throughout the home. The second optional duct damper can be installed in the large fresh air flex duct (This is backup to sealing off incoming fresh air from the low-profile roof vent or gable vent). The Filtered Fresh Air System 100 of an example embodiment can utilize the supply plenum and supply ducting of a standard HVAC system to distribute filtered fresh outdoor air throughout the building space using the air ducting already installed in the building. The Filtered Fresh Air System 100 of an example embodiment can work in conjunction with most whole house fan systems on the market today. However, to have the optimal experience, the Filtered Fresh Air System 100 of various example embodiments should be coupled with the CVT WHF 148.

FIGS. 1 through 5 illustrate example embodiments of the components of the disclosed apparatus for providing a selective filtered fresh air source using existing ducting, along with CVT CB 145, an optional Wi-Fi wall switch 147, optional CVT Wi-Fi PNP 153, CVT App 160, and operations to seal and power off existing HVAC equipment if CO/Refrigerant Gas is detected and operations to flush the structure with fresh filtered air.

Figure 2:
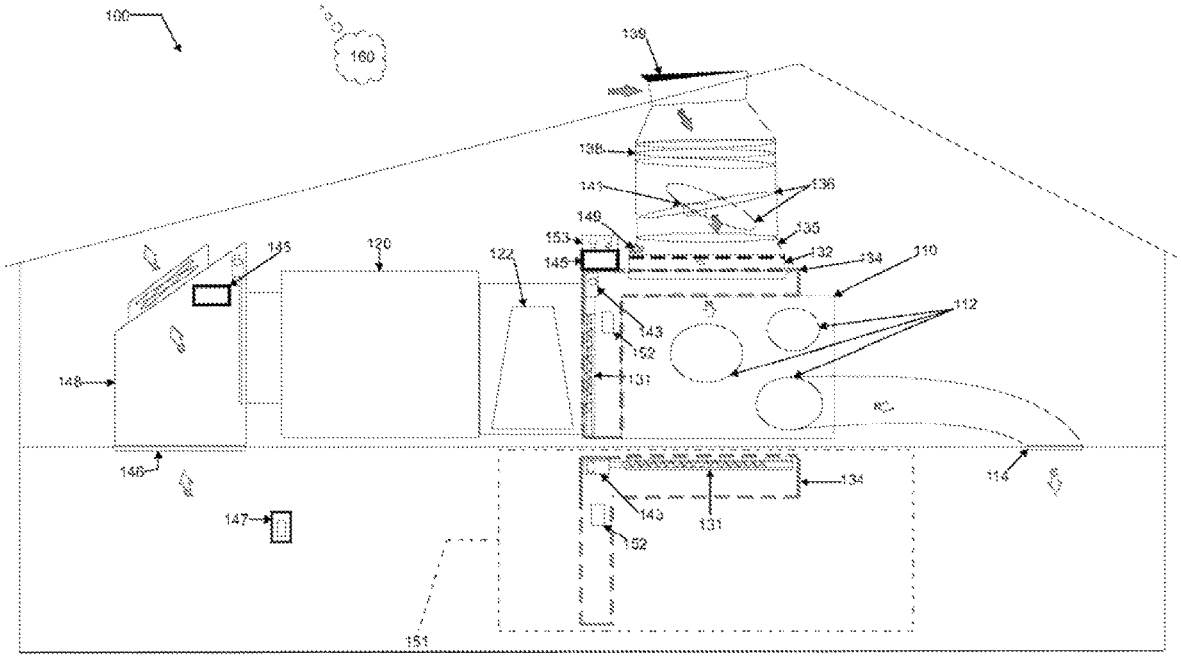
FIG. 2 illustrates an example embodiment with the "L" shaped transition box with a flag damper between the existing HVAC evaporative coil and the existing HVAC plenum supply box.
Figure 3:
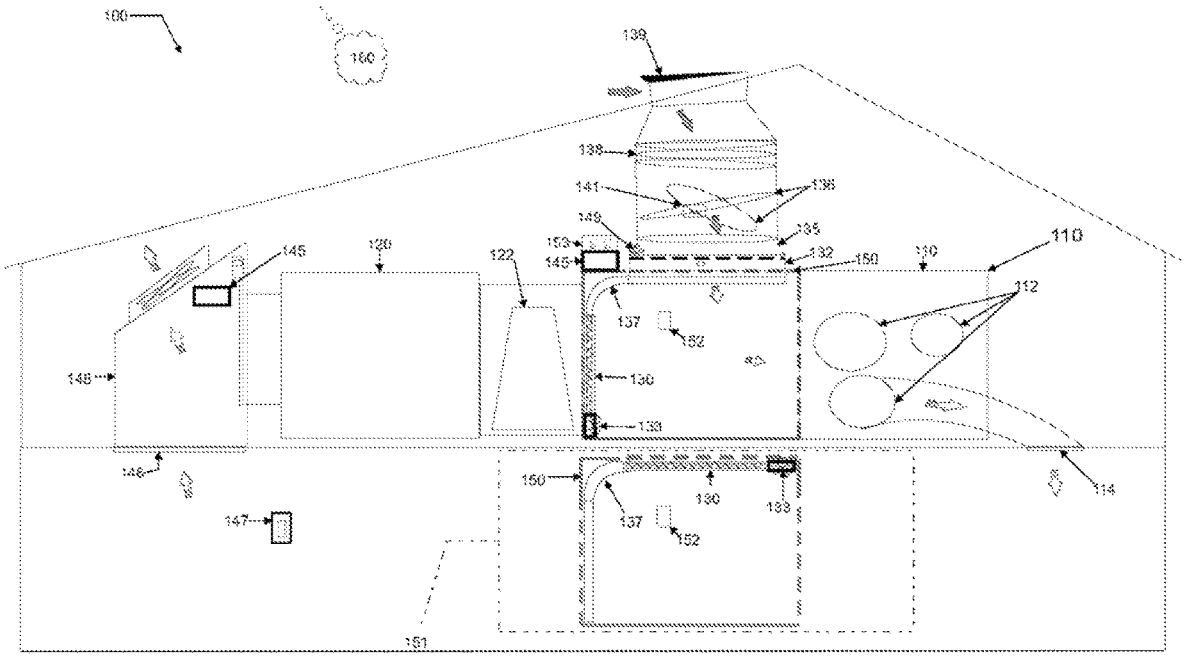
FIG. 3 illustrates an example embodiment with a transition box with the rolling damper between the existing HVAC evaporative coil and the existing HVAC plenum supply box.
Figure 4:
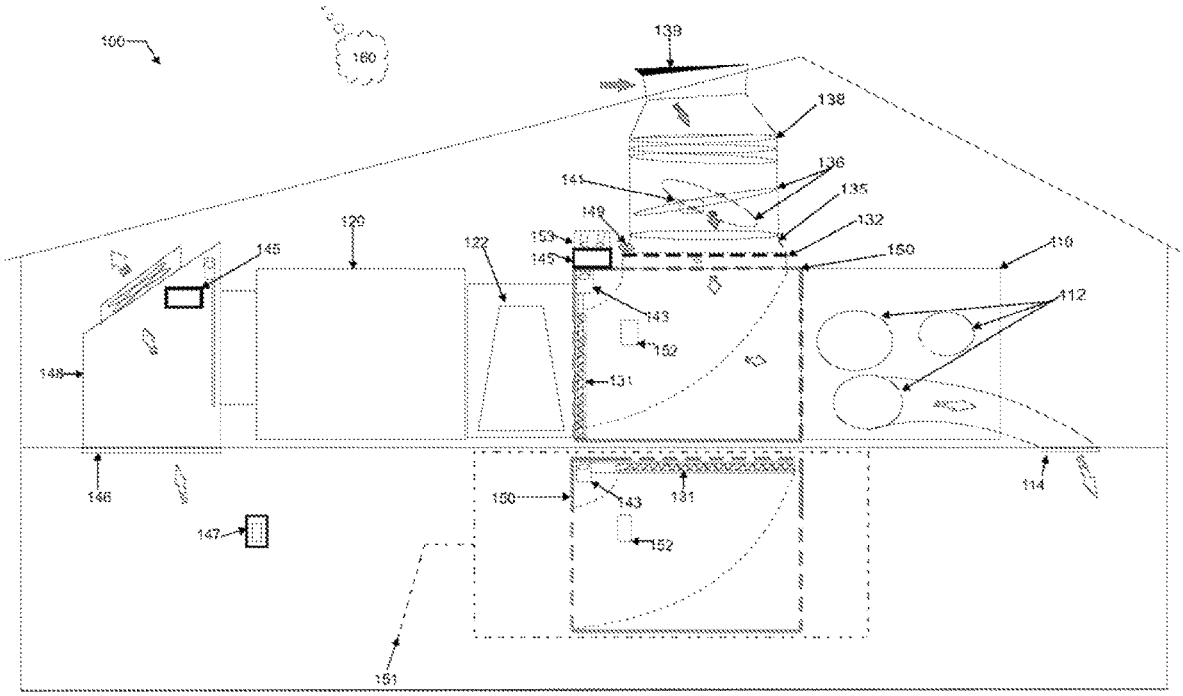
FIG. 4 illustrates an example embodiment with a transition box with the flag damper between the existing HVAC evaporative coil and the existing HVAC plenum supply box.
Figure 5:
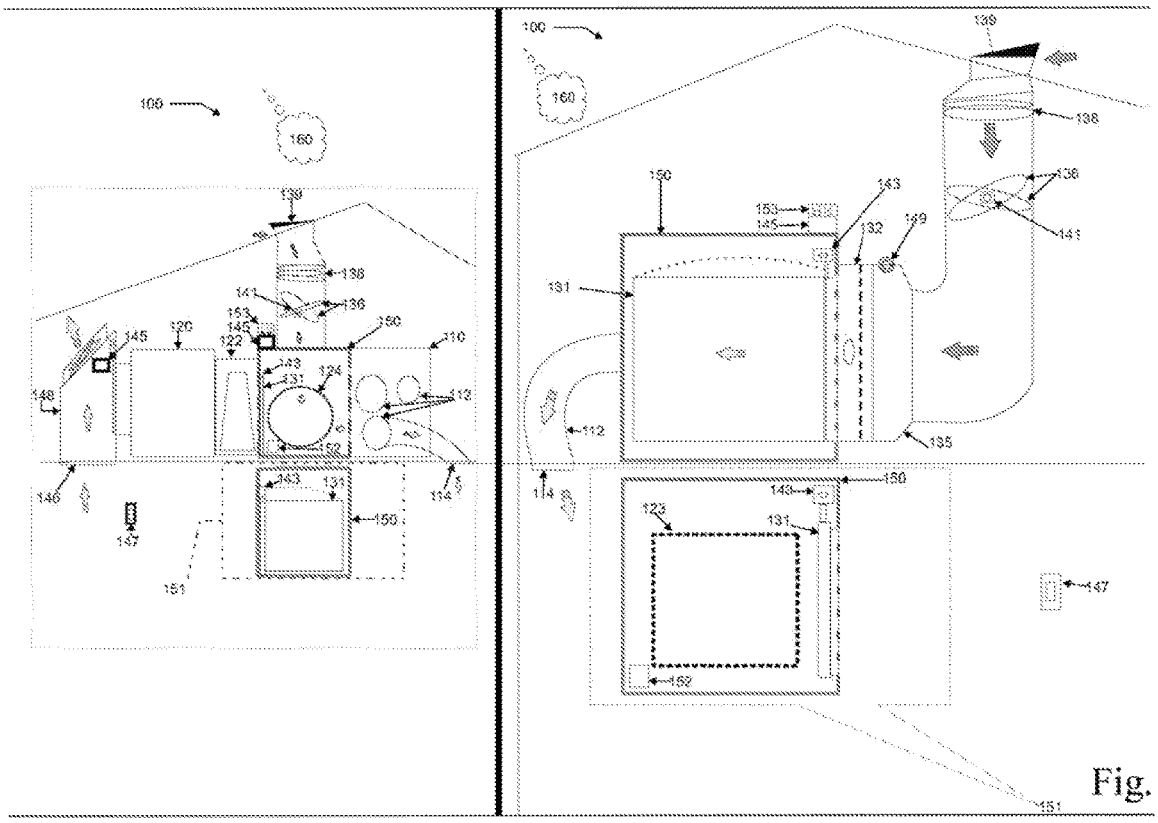
FIG. 5 illustrates a large side view and a small frontal view of example embodiments with a transition box coupled to a side mounted filter box and a side mounted flag damper between the existing HVAC evaporative coil and the existing HVAC plenum supply box.

FIG. 1 illustrates an example embodiment of an "L" shaped transition box with a dual position rolling damper installed between the existing HVAC evaporative coil and the existing HVAC plenum supply box. FIG. 2 illustrates an example embodiment of an "L" shaped transition box with a dual position flag damper installed between the existing HVAC evaporative coil and the existing HVAC plenum supply box. FIG. 3 illustrates an example embodiment of a transition box with a dual position rolling damper installed between the existing HVAC evaporative coil and the existing HVAC plenum supply box. FIG. 4 illustrates an example embodiment of a transition box with a dual position flag damper installed between the existing HVAC evaporative coil and the existing HVAC plenum supply box. FIG. 5 illustrates a large side view and a small frontal view example embodiments with a transition box coupled to a side mounted filter box and a side mounted dual position flag damper installed between the existing HVAC evaporative coil and the existing HVAC plenum supply box. Although this view features a side mounted dual position flag damper, this application could also be installed with a side mounted dual position rolling damper, track, and rolling actuator.

Referring now to FIG. 1 in an example embodiment, the Filtered Fresh Air System 100 is shown when it is in the active "On" position. This FIG. 1 shows the CVT CB 145 twice. This is not a mistake; it is an option. If the install of the Filtered Fresh Air System 100 is coupled to the CVT WHF 148 then the Filtered Fresh Air System 100 will couple to the CVT CB 145 that is already attached to the CVT WHF 148. However, if the Filtered Fresh Air System 100 is installed independently, it will couple to its own CVT CB 145 that will be attached to the top of the transition box. Only one is needed to run the Filtered Fresh Air System 100.

In the event that the Filtered Fresh Air System 100 is installed independently with an existing whole house fan other than the CVT WHF 148, then Filtered Fresh Air System 100 will couple to the CVT CB 145 that can be installed on the "L" shaped transition box 134. The existing whole house fan (Non-CVT WHF) will couple to the CVT Wi-Fi PNP 153, and communicate through the CVT App 160. The Filtered Fresh Air System 100 can be controlled by the optional Wi-Fi wall switch 147, and or the CVT App 160.

In tandem with the activation, "On" position of the Filtered Fresh Air System 100, the CVT WHF 148 or existing whole house fan will pull outside air through the Filtered Fresh Air System 100. The activation of the rolling damper actuator 133 will cause the dual position rolling damper 130 to move down, along the damper track 137 from a closed position to an open position inside the "L" shaped transition box 134. This seals off the access to the existing HVAC evaporative coil 122 and existing HVAC Furnace/Air Handler 120 and opens the access to the existing HVAC plenum 110 and interior of the home/structure. At the same time, the optional actuator 141 will move the optional round duct damper 136 to non-horizontal (e.g., from a closed to an open position), thereby allowing outside fresh air to be pulled through the low-profile roof vent or gable vent 139, through the large flex duct 138, and past the optional duct damper 136. The air passes through a round to rectangle sheet metal collar 135. The air passes by optional UV light 149, and through a filter box 132 where a filter is installed. Because the Filtered Fresh Air System 100 is in the "On" position and the dual position rolling damper 130 is blocking the evaporative coil 122, the filtered fresh air can freely enter the "L" shaped transition box chamber 134. The air is pulled past a CO/Refrigerant gas detector 152, then the filtered fresh air enters through the existing HVAC plenum supply box 110, through all the existing HVAC supply ducts 112, and through the existing supply vents 114. Now that the filtered fresh air is in the home/structure, the air will either be pulled through the existing ceiling return 146, and CVT WHF 148 and into the attic cooling it off OR if they do not have a CVT WHF 148, then the filtered fresh air can be pulled through another brand of existing whole house fan. The arrows indicate the flow of outside air being pulled through the Filtered Fresh Air System 100 and circulating the interior air out through the CVT WHF 148 or existing whole house fan. (Existing whole house fans are not illustrated in the figures.)

The portion of FIG. 1 identified by the callout 151 shows an alternate view of the dual position rolling damper in the closed "Off" position (closing off the outside filtered fresh air) and opening the path to the existing HVAC evaporative coil 122. This position allows for normal function of the existing HVAC Furnace/Air Handler system 120.

The Filtered Fresh Air System 100 as disclosed herein can augment the existing HVAC system to add additional components to effect the selective sourcing of filtered fresh air using the ducting of the existing HVAC Furnace/Air Handler system 120.

Referring now to FIG. 2 in an example embodiment, the Filtered Fresh Air System 100 is shown when it is in the active "On" position. This FIG. 2 shows the CVT CB 145 twice. This is not a mistake; it is an option. If the install of the Filtered Fresh Air System 100 is coupled to the CVT WHF 148 then the Filtered Fresh Air System 100 will couple to the CVT CB 145 that is already attached to the CVT WHF 148. However, if the Filtered Fresh Air System 100 is installed independently, it will couple to its own CVT CB 145 that will be attached to the top of the transition box. Only one is needed to run the Filtered Fresh Air System 100.

In the event that the Filtered Fresh Air System 100 is installed independently with an existing whole house fan other than the CVT WHF 148, then Filtered Fresh Air System 100 will couple to the CVT CB 145 that can be installed on the "L" shaped transition box 134. The existing whole house fan (Non-CVT WHF) will couple to the CVT Wi-Fi PNP 153, and communicate through the CVT App 160. The Filtered Fresh Air System 100 can be controlled by the optional Wi-Fi wall switch 147, and or the CVT App 160.

In tandem with the activation, "On" position of the Filtered Fresh Air System 100, the CVT WHF 148 or existing whole house fan will pull outside air through the Filtered Fresh Air System 100. The activation of the damper actuator 143 will cause the dual position flag damper 131 to move down from a closed position to an open position inside the "L" shaped transition box 134. This seals off the access to the existing HVAC evaporative coil 122 and existing HVAC Furnace/Air Handler 120 and opens the access to the existing HVAC plenum 110 and interior of the home/structure. At the same time, the optional actuator 141 will move the optional round duct damper 136 to non-horizontal (e.g., from a closed to an open position), thereby allowing outside fresh air to be pulled through the low-profile roof vent or gable vent 139, through the large flex duct 138, and past the optional duct damper 136. The air passes through a round to rectangle sheet metal collar 135. The air passes by optional UV light 149, through a filter box 132 where a filter is installed. Because the Filtered Fresh Air System 100 is in the "On" position and the dual position flag damper 131 is blocking the evaporative coil 122, the filtered fresh air can freely enter the "L" shaped transition box 134 chamber. The air is pulled past a CO/Refrigerant gas detector 152. Then, the filtered fresh air enters through the existing HVAC plenum supply box 110, through all the existing HVAC supply ducts 112, and through the existing supply vents 114. Once the filtered fresh air is in the home/structure, the air will either be pulled through the existing ceiling return 146, and CVT WHF 148 and into the attic cooling it off OR if they do not have a CVT WHF 148, then the filtered fresh air can be pulled through another brand of existing whole house fan. The arrows indicate the flow of outside air being pulled through the Filtered Fresh Air System 100 and circulating the interior air out through the CVT WHF 148 or existing whole house fan. (Existing whole house fans are not illustrated in the figures.)

The portion of FIG. 2 identified by the callout 151 shows an alternate view of the dual position flag damper in the closed "Off" position (closing off the outside filtered fresh air) and opening the path to the existing HVAC evaporative coil 122. This position allows for normal function of the existing HVAC Furnace/Air Handler system 120.

The Filtered Fresh Air System 100 as disclosed herein can augment the existing HVAC system to add additional components to affect the selective sourcing of filtered fresh air using the ducting of the existing HVAC Furnace/Air Handler system 120.

Referring now to FIG. 3 in an example embodiment, the Filtered Fresh Air System 100 when it is in the active "On" position. This FIG. 3 shows the CVT CB 145 twice. This is not a mistake; it is an option. If the install of the Filtered Fresh Air System 100 is coupled to the CVT WHF 148 then the Filtered Fresh Air System 100 will couple to the CVT CB 145 that is already attached to the CVT WHF 148. However, if the Filtered Fresh Air System 100 is installed independently, it will couple to its own CVT CB 145 that will be attached to the top of the transition box. Only one is needed to run the Filtered Fresh Air System 100.

In the event that the Filtered Fresh Air System 100 is installed independently with an existing whole house fan other than the CVT WHF 148, then Filtered Fresh Air System 100 will couple to the CVT CB 145 that can be installed on the transition box 150. The existing whole house fan (Non-CVT WHF) will couple to the CVT Wi-Fi PNP 153, and communicate through the CVT App 160. The Filtered Fresh Air System 100 can be controlled by the optional Wi-Fi wall switch 147, and or the CVT App 160.

In tandem with the activation, "On" position of the Filtered Fresh Air System 100, the CVT WHF 148 or existing whole house fan will pull outside air through the Filtered Fresh Air System 100. The activation of the rolling damper actuator 133 will cause the dual position rolling damper 130 to move down, along the damper track 137 from a closed position to an open position inside the transition box 150. This seals off the access to the existing HVAC evaporative coil 122 and existing HVAC Furnace/Air Handler 120 and opens the access to the existing HVAC plenum 110 and interior of the home/structure. At the same time, the optional actuator 141 will move the optional round duct damper 136 to non-horizontal (e.g., from a closed to an open position), thereby allowing outside fresh air to be pulled through the low-profile roof vent or gable vent 139, through the large flex duct 138, and past the optional duct damper 136. The air passes through a round to rectangle sheet metal collar 135, air passes by optional UV light 149, through a filter box 132 where a filter is installed. Because the Filtered Fresh Air System 100 is in the "On" position and the dual position rolling damper 130 is blocking the evaporative coil 122, the filtered fresh air can freely enter the transition box 150 chamber. The air is pulled past a CO/Refrigerant gas detector 152, then the filtered fresh air enters through the existing HVAC plenum supply box 110, through all the existing HVAC supply ducts 112, through the existing supply vents 114. Once the filtered fresh air is in the home/structure, the air will either be pulled through the existing ceiling return 146, and CVT WHF 148 and into the attic cooling it off OR if they do not have a CVT WHF 148, then the filtered fresh air can be pulled through another brand of existing whole house fan. The arrows indicate the flow of outside air being pulled through the Filtered Fresh Air System 100 and circulating the interior air out through the CVT WHF 148 or existing whole house fan. (Existing whole house fans are not illustrated in the figures.)

The portion of FIG. 3 identified by the callout 151 shows an alternate view of the dual position rolling damper in the closed "Off" position (closing off the outside filtered fresh air) and opening the path to the existing HVAC evaporative coil 122. This position allows for normal function of the existing HVAC Furnace/Air Handler system 120.

The Filtered Fresh Air System 100 as disclosed herein can augment the existing HVAC system to add additional components to affect the selective sourcing of filtered fresh air using the ducting of the existing HVAC Furnace/Air Handler system 120.

Referring now to FIG. 4 in an example embodiment, the Filtered Fresh Air System 100 when it is in the active "On" position. This FIG. 4 shows the CVT CB 145 twice. This is not a mistake; it is an option. If the install of the Filtered Fresh Air System 100 is coupled to the CVT WHF 148 then the Filtered Fresh Air System 100 will couple to the CVT CB 145 that is already attached to the CVT WHF 148. However, if the Filtered Fresh Air System 100 is installed independently, it will couple to its own CVT CB 145 that will be attached to the top of the transition box. Only one is needed to run the Filtered Fresh Air System 100.

In the event that the Filtered Fresh Air System 100 is installed independently with an existing whole house fan other than the CVT WHF 148, then Filtered Fresh Air System 100 will couple to the CVT CB 145 that can be installed on the transition box 150. The existing whole house fan (Non-CVT WHF) will couple to the CVT Wi-Fi PNP 153, and communicate through the CVT App 160. The Filtered Fresh Air System 100 can be controlled by the optional Wi-Fi wall switch 147, and or the CVT App 160.

In tandem with the activation, "On" position of the Filtered Fresh Air System 100, the CVT WHF 148 or existing whole house fan will pull outside air through the Filtered Fresh Air System 100. The activation of the actuator 143 will cause the dual position flag damper 131 to move down from a closed position to an open position inside the transition box 150. This seals off the access to the existing HVAC evaporative coil 122 and existing HVAC Furnace/Air Handler 120 and opens the access to the existing HVAC plenum 110 and interior of the home/structure. At the same time, the optional actuator 141 will move the optional round duct damper 136 to non-horizontal (e.g., from a closed to an open position), thereby allowing outside fresh air to be pulled through the low-profile roof vent or gable vent 139, through the large flex duct 138, past the optional duct damper 136, the air passes through a round to rectangle sheet metal collar 135, air passes by optional UV light 149, through a filter box 132 where a filter is installed. Now, since the Filtered Fresh Air System 100 is in the "On" position and the dual position flag damper 131 is blocking of the evaporative coil 122, the filtered fresh air can freely enter the transition box 150 chamber. The air is pulled past a CO/Refrigerant gas detector 152, then the filtered fresh air enters through the existing HVAC plenum supply box 110, through all the existing HVAC supply ducts 112, through the existing supply vents 114. Once the filtered fresh air is in the home/structure, the air will either be pulled through the existing ceiling return 146, and CVT WHF 148 and into the attic cooling it off OR if they do not have a CVT WHF 148, then the filtered fresh air can be pulled through another brand of existing whole house fan. The arrows indicate the flow of outside air being pulled through the Filtered Fresh Air System 100 and circulating the interior air out through the CVT WHF 148 or existing whole house fan. (Existing whole house fans are not illustrated in the figures.)

The portion of FIG. 4 identified by the callout 151 shows an alternate view of the dual position flag damper in the closed "Off" position (closing off the outside filtered fresh air) and opening the path to the existing HVAC evaporative coil 122. This position allows for normal function of the existing HVAC Furnace/Air Handler system 120.

The Filtered Fresh Air System 100 as disclosed herein can augment the existing HVAC system to add additional components to affect the selective sourcing of filtered fresh air using the ducting of the existing HVAC Furnace/Air Handler system 120.

Referring now to FIG. 5 in an example embodiment the Filtered Fresh Air System 100, when it is in the active "On" position. FIG. 5 includes two views: on the right, a large side view, and on the left a smaller frontal view (to visualize how the ducting is mounted to the side of the transition box 150).

On the upper right side of FIG. 5, the large side view of the Filtered Fresh Air System 100 is shown. This side view of the transition box 150 shows the side mounted dual position damper 131 in the open or "On" position (closing off the existing evaporative coil 122) and opening up to the existing HVAC supply plenum 110 and existing supply ducts 112.

On the upper left side of FIG. 5, the small frontal view of the Filtered Fresh Air System 100 is shown. This frontal view of the transition box 150 shows the side mounted dual position damper 131 in the open or "On" position (closing off the existing evaporative coil 122) and opening up the path 124 to the existing HVAC supply plenum 110, the existing supply ducts 112 and the existing supply vents 114 throughout the home/structure.

FIG. 5 also shows the CVT CB control board 145 once on the upper right large side view and twice on the upper left small side view. This is not a mistake; it is an option. If the install of the Filtered Fresh Air System 100 is coupled to the CVT WHF 148 then the Filtered Fresh Air System 100 will couple to the CVT CB 145 that is already attached to the CVT WHF 148. However, if the Filtered Fresh Air System 100 is installed independently, it will couple to its own CVT CB 145 that will be attached to the top of the transition box. Only one is needed in each view to run the Filtered Fresh Air System 100.

In the event that the Filtered Fresh Air System 100 is installed independently with an existing whole house fan other than the CVT WHF 148, then Filtered Fresh Air System 100 will couple to the CVT CB 145 that can be installed on the transition box 150. The existing whole house fan (Non-CVT WHF) will couple to the CVT Wi-Fi PNP 153, and communicate through the CVT App 160. The Filtered Fresh Air System 100 can be controlled by the optional Wi-Fi wall switch 147, and or the CVT App 160.

In tandem with the activation, "On" position of the Filtered Fresh Air System 100, the CVT WHF 148 or existing whole house fan will pull outside air through the Filtered Fresh Air System 100. The activation of the actuator 143 will cause the dual position flag damper 131 to move down from a closed position to an open position inside the transition box 150. This seals off the access to the existing HVAC evaporative coil 122 and existing HVAC Furnace/Air Handler 120 and opens the access to the existing HVAC plenum 110 and interior of the home/structure. At the same time, the optional actuator 141 will move the optional round duct damper 136 to non-horizontal (e.g., from a closed to an open position), thereby allowing outside fresh air to be pulled through the low-profile roof vent or gable vent 139, through the large flex duct 138, past the optional duct damper 136, the air passes through a round to rectangle sheet metal collar 135, air passes by optional UV light 149, through a filter box 132 where a filter is installed. Now, since the Filtered Fresh Air System 100 is in the "On" position and the dual position flag damper 131 is blocking the evaporative coil 122, the filtered fresh air can freely enter the transition box 150 chamber. The air is pulled past a CO/Refrigerant gas detector 152, then the filtered fresh air enters through the existing HVAC plenum supply box 110, through all the existing HVAC supply ducts 112, through the existing supply vents 114. Once the filtered fresh air is in the home/structure, the air will either be pulled through the existing ceiling return 146, and CVT WHF 148 and into the attic cooling it off OR if they do not have a CVT WHF 148, then the filtered fresh air can be pulled through another brand of existing whole house fan. The arrows indicate the flow of outside air being pulled through the Filtered Fresh Air System 100 and circulating the interior air out through the CVT WHF 148 or existing whole house fan. (Existing whole house fans are not illustrated in the figures.)

The portion of figures identified by the callout 151 shows alternate views of the dual position flag damper in the closed "Off" position (closing off the outside filtered fresh air) and opening the path to the existing HVAC evaporative coil 122. This position allows for normal function of the existing HVAC Furnace/Air Handler system 120. Though not pictured in the FIG. 5, this same application can be configured with a side mounted rolling damper and rolling actuator on a curved damper track.

The Filtered Fresh Air System 100 as disclosed herein can augment the existing HVAC system to add additional components to affect the selective sourcing of filtered fresh air using the ducting of the existing HVAC Furnace/Air Handler system 120.

Referring again to FIG. 1, when the Filtered Fresh Air System 100 is "Off" (callout 151 inactive), the dual position rolling damper 130 can be moved up into a closed position by a rolling actuator 133, on a curved track 137. In the "Off" position, the dual position rolling damper 130 closes off the filter box 132 from the "L" shaped transition box 134, which blocks off the outside air. The optional round duct damper 136 is moved into a closed position (non-vertical) by the optional actuator 141. In this closed position, the outside air is sealed off from the flex duct 138 and the low-profile outside air roof vent or gable vent 139 preventing outside air from entering the home/structure.

When the Filtered Fresh Air System 100 is "Off" (callout 151 inactive) the existing evaporative coil 122 and existing HVAC Furnace/Air Handler 120 are open to the "L" shaped transition box 134 and existing plenum supply box 110, existing supply ducts 112 and existing supply vents 114 into the interior of the home/structure allowing for normal HVAC use.

Referring again to FIG. 2, when the Filtered Fresh Air System 100 is "Off" (callout 151 inactive), the dual position flag damper 131 can be moved up into a closed position by an actuator 143. In the "Off" position, the dual position flag damper 131 closes off the filter box 132 from the "L" shaped transition box 134, which blocks off the outside air. The optional round duct damper 136 is moved into a closed position (non-vertical) by the optional actuator 141. In this closed position, the outside air is sealed off from the flex duct 138 and the low-profile outside air roof vent or gable vent 139 preventing outside air from entering the home/structure.

When the Filtered Fresh Air System 100 is "Off" (callout 151 inactive) the existing evaporative coil 122 and existing HVAC Furnace/Air Handler 120 are open to the "L" shaped transition box 134 and existing plenum supply box 110, existing supply ducts 112 and existing supply vents 114 into the interior of the home/structure allowing for normal HVAC use.

Referring again to FIG. 3 when the Filtered Fresh Air System 100 is "Off" (callout 151 inactive), the dual position rolling damper 130 can be moved up into a closed position by a rolling actuator 133, on a curved track 137. In the "Off" position, the dual position rolling damper 130 closes off the filter box 132 from the transition box 150, which blocks off the outside air. The optional round duct damper 136 is moved into a closed position (non-vertical) by the optional actuator 141. In this closed position, the outside air is sealed off from the flex duct 138 and the low-profile outside air roof vent or gable vent 139 preventing outside air from entering the home/structure.

When the Filtered Fresh Air System 100 is "Off" (callout 151 inactive) the existing evaporative coil 122 and existing HVAC Furnace/Air Handler 120 are open to the transition box 150 and existing plenum supply box 110, existing supply ducts 112 and existing supply vents 114 into the interior of the home/structure allowing for normal HVAC use.

Referring again to FIG. 4, when the Filtered Fresh Air System 100 is "Off" (callout 151 inactive), the dual position flag damper 131 can be moved up into a closed position by an actuator 143. In the "Off" position, the dual position flag damper 131 closes off the filter box 132 from the transition box 150, which blocks off the outside air. The optional round duct damper 136 is moved into a closed position (non-vertical) by the optional actuator 141. In this closed position, the outside air is sealed off from the flex duct 138 and the low-profile outside air roof vent or gable vent 139 preventing outside air from entering the home/structure.

When the Filtered Fresh Air System 100 is "Off" (callout 151 inactive) the existing evaporative coil 122 and existing HVAC Furnace/Air Handler 120 are open to the transition box 150 and existing plenum supply box 110, existing supply ducts 112 and existing supply vents 114 into the interior of the home/structure allowing for normal HVAC use.

Referring again to FIG. 5 in an example embodiment, the diagram shows when the Filtered Fresh Air System 100, is "Off" (callout 151 inactive) or when it is in the inactive "Off" position. FIG. 5 includes two views: on the right, a large side view, and on the left a smaller frontal view (to visualize how the ducting is mounted to the side of the transition box 150). Though not pictured in the FIG. 5, this same application can be configured with a side mounted rolling damper and rolling actuator on a curved damper track.

On the lower right side of FIG. 5, the large side view of the Filtered Fresh Air System 100, the callout 151 is an alternate view of the side mounted flag damper 131 in the closed or "Off" position (closing off the outside filtered fresh air). The side mounted flag damper 131 is sealed against the filter box 132 allowing an open path 123 to the existing HVAC/furnace 120 and existing evaporative coil 122. This "Off" position allows for normal function of the existing HVAC Furnace/Air Handler system 120.

On the lower left side of FIG. 5, the small view of the Filtered Fresh Air System 100, the callout 151 is an alternate view of the side mounted flag damper 131 in the closed or "Off" position (closing off the outside filtered fresh air). The side mounted flag damper 131 is sealed against the path 124 and filter box 132. This "Off" position opens up the path to the existing HVAC Furnace/Air Handler 120 and existing evaporative coil 122. This "Off" position allows for normal function of the existing HVAC system.

The Filtered Fresh Air System 100 of the example embodiments disclosed herein, can utilize the already existing ductwork that the majority of structure/homes already have. The Filtered Fresh Air System 100 will also filter the outside fresh air before the air enters the transition boxes 134 or 150. The Filtered Fresh Air System 100 of the example embodiments fits between HVAC supply plenums 110 and HVAC evaporative coils 122 that are already installed. These transition boxes 134 and 150 are placed in front of the coil 122 to prevent and protect the coil 122 from debris.

With the Filtered Fresh Air System 100 there will be no need to open windows or doors when turning on any whole house fans. This means the user can operate the system with the CVT App 160 when they are away from their home. The user can keep their home closed up and their alarm system on while controlling everything with their CVT App 160. As a result, the Filtered Fresh Air System 100 of the example embodiments makes every home more secure, cleaner and more energy efficient. The Filtered Fresh Air System 100 of the example embodiments can include a CVT App 160, CVT CB 145, an optional Wi-Fi wall switch 147, and an optional CVT Wi-Fi PNP 153. The CVT App 160 can be interfaced with an existing smart thermostat. The CVT CB 145 can communicate independently with the Filtered Fresh Air System 100, or be combined with the CVT WHF 148, CVT FFC and or the CVT Wi-Fi PNP (that an existing Non-CVT WHF can plug into).

The CVT App 160 can be configured to do many things. For example, the CVT App 160 has a Wi-Fi connection to communicate/update to other IOT platform/logic/smart thermostats multiple brands, variable switches, manual switches both known and unknown. The CVT App 160 can be set up with logins/passwords with several users and allow for user restrictions. The CVT App 160 can set up multiple Filtered Fresh Air System 100, CVT WHF's 148 and CVT FFC's in different parts of the structure/home. The CVT App 160 can turn On/Off CVT WHF 148 and/or existing whole house fans (When the Non-CVT WHF is connected to the CVT Wi-Fi PNP). The CVT App 160 can turn On/Off Filtered Fresh Air System 100 and or CVT FFC. The CVT App 160 can integrate with the CVT FFC (This will allow access to parts of the home without existing HVAC supply ducts or for extra fresh air needed to accommodate the cfm of the whole house fan). The CVT App 160 can be voice activated thru different platform logic both known and unknown. The CVT App 160 can set schedules/run times/time zones. The CVT App 160 can show the user the energy use on graphs and reports.

Because the CVT App 160 can be interfaced with the CVT CB 145 and or smart thermostats, it can pull local weather and indoor temperatures. This allows the user to set the Filtered Fresh Air System 100 to turn on when it identifies the user's set points for ideal indoor temperature. These set points will be based on when the ideal current outside temperature is cooler than the inside temperature of a home/structure in which an HVAC unit and whole house fan system are installed. In this case, the CVT App 160 can be configured or send alerts to the user to deactivate the HVAC unit and energize or activate the Filtered Fresh Air System 100 and the whole house fan system as described above. In this manner, the Filtered Fresh Air System 100 disclosed herein and the CVT WHF 148 or existing whole house fan system can cool a structure with filtered fresh air at a fraction of the cost relative to operation of the HVAC system. These set points will keep the system from turning on if the outside weather is too hot or too cold. This IOT App can learn and operate with other ecosystem logic and or devices. These functions are only available when connected to the CVT CB 145.

The CVT App 160 can send alerts if the CO/Refrigerant gas detector 152 senses CO or Refrigerant gas in the home/structure, Existing HVAC system will be shut off and the fresh air system 100 will turn on automatically along with the CVT WHF 148 or existing whole house fan, to flush the CO or Refrigerant gas out of the structure. The CVT App 160 will alert the user and prompt them with options to contact emergency services and or a service company to respond to the alert. These functions are only available when connected to the CVT CB 145.

Safeties are configured into the software of the CVT CB 145 to ensure the HVAC system and the whole house fan system will not activate at the same time. Also, safety interlocks can be installed on dampers to prevent the Filtered Fresh Air System 100 and the whole house fan system from running with the dampers in the wrong positions. Dampers can be configured with spring return safeties that will move dampers back to an off (inactive) position in the event of a power failure.

Figure 6:
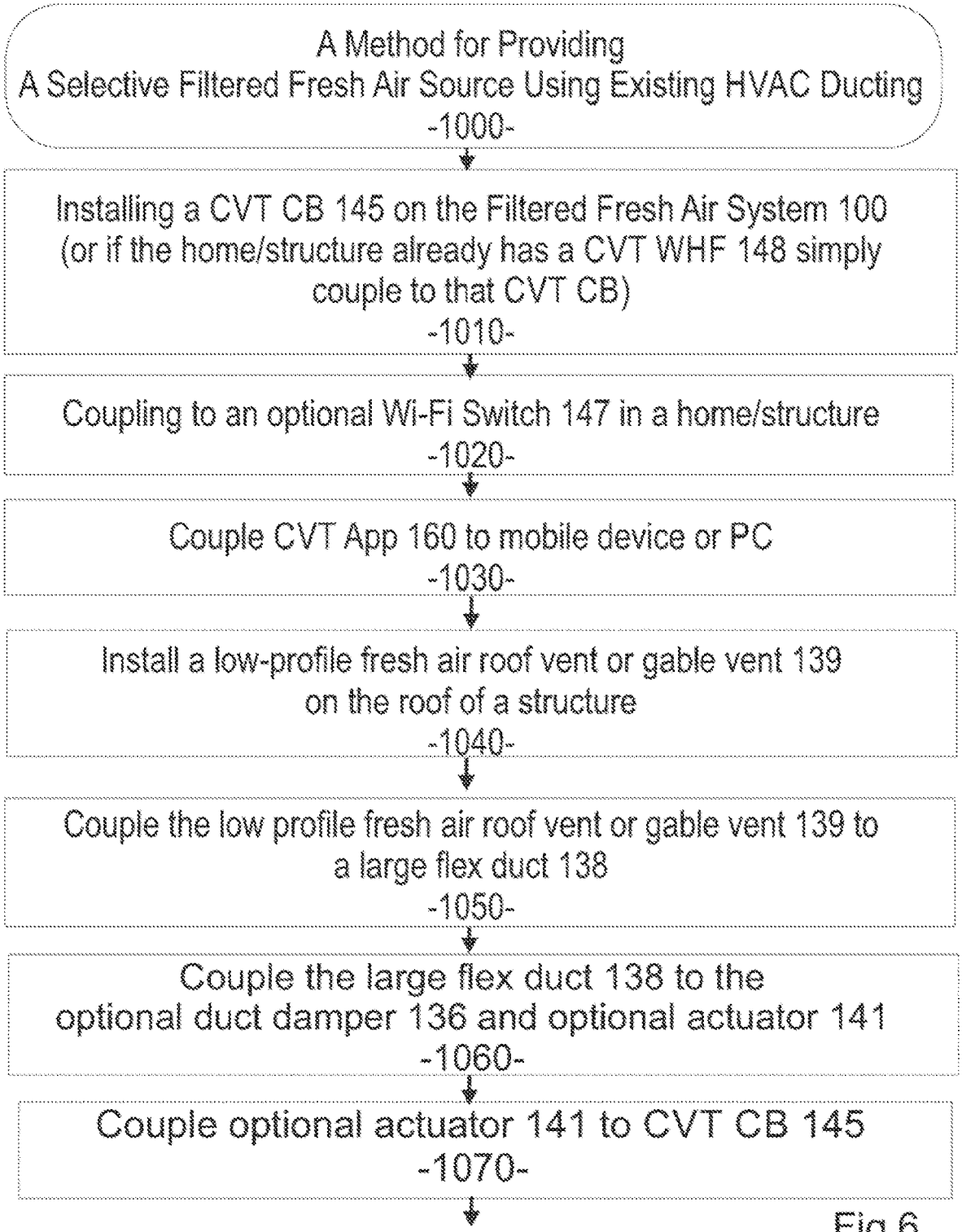
FIGS. 6, 7 and 8 illustrate flow diagrams representing sequences of operations performed in methods according to example embodiments.
Figure 7:
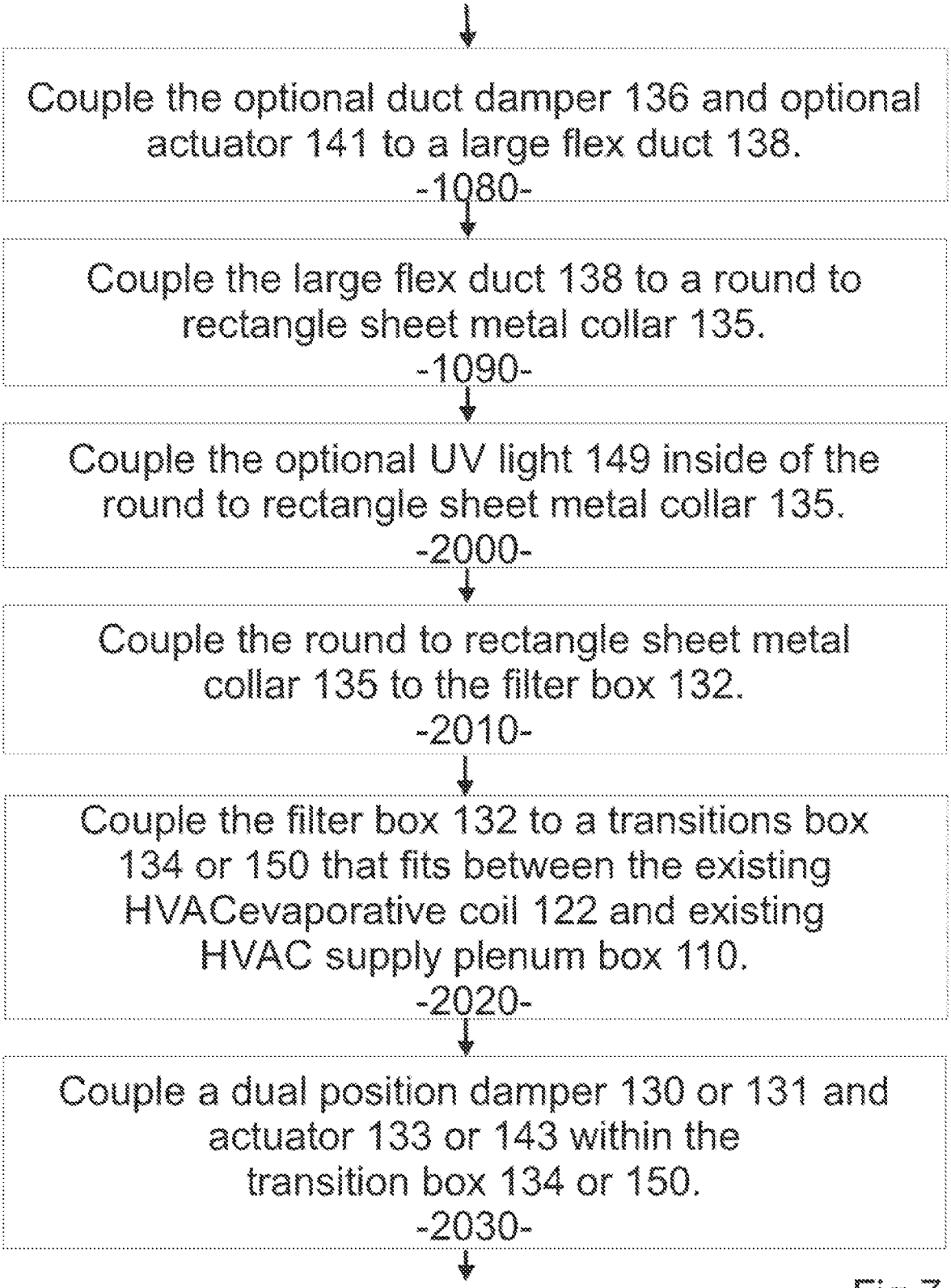
Figure 8:
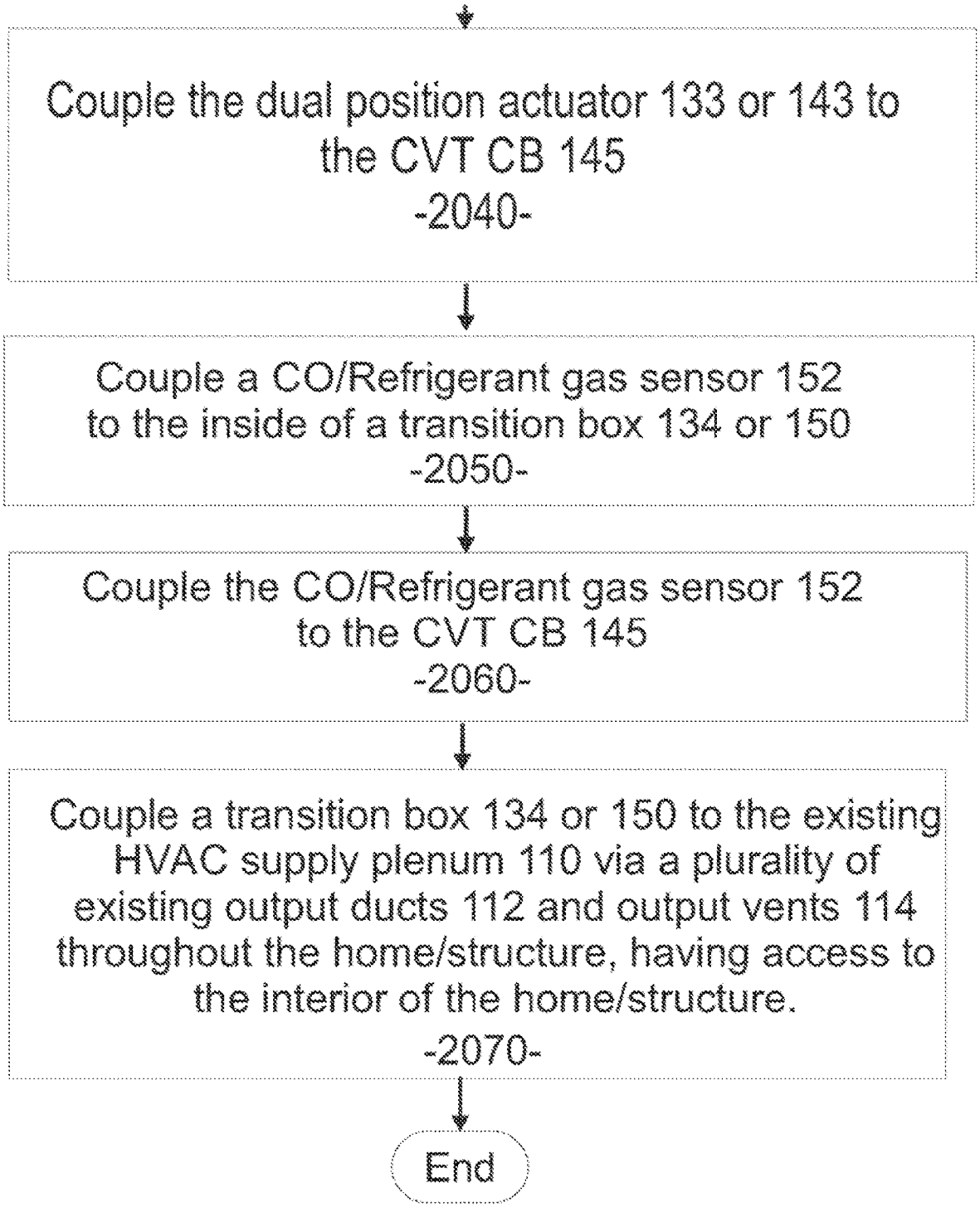

Referring to FIGS. 6, 7 and 8, the figures illustrate flow diagrams representing a sequence of operations performed in a method according to an example embodiment. An example embodiment of a method includes: A Method for Providing A Selective Filtered Fresh Air Source Using Existing HVAC Ducting (Operation 1000); Installing a CVT control board 145 on the Filtered Fresh Air System 100 (or if the home/structure already has a CVT WHF 148 simply couple the existing CVT CB 145 to the Filtered Fresh Air System 100) (Operation 1010); coupling to an optional Wi-Fi wall switch 147 in a home/structure (Operation 1020); coupling CVT App 160 on mobile device or PC (Operation 1030); Install a low-profile fresh air roof vent or gable vent 139 on the roof of a structure (Operation 1040); coupling the low-profile fresh air roof vent or gable vent 139 to a large flex duct 138 (Operation 1050); coupling a large flex duct 138 to an optional duct damper 136 and optional actuator 141 (Operation 1060); coupling optional actuator 141 to CVT CB 145 (Operation 1070); coupling the optional duct damper 136 and optional actuator 141 to a large flex duct 138 (Operation 1080); coupling the large flex duct 138 to a round to rectangle sheet metal collar 135 (Operation 1090); coupling an optional UV light 149 to inside the round to rectangle sheet metal collar 135 (Operation 2000); coupling a round to rectangle sheet metal collar 135 to a filter box 132 (Operation 2010); coupling a filter box 132 to a transition box 134 or 150 that fits between the existing HVAC evaporative coil 122 and existing HVAC supply plenum box 110 (Operation 2020); coupling a dual position damper 130 or 131 and actuator 133 or 143 within the transition box 134 or 150 (Operation 2030); coupling the dual position actuator 133 or 143 to the CVT CB 145 (Operation 2040); coupling a CO/Refrigerant gas detector 152 to a transition box 134 or 150 (Operation 2050); coupling the CO/Refrigerant gas detector 152 to the CVT CB 145 (Operation 2060); and coupling a transition box 134 or 150 to the existing HVAC supply plenum 110 via a plurality of existing output ducts 112 and output vents 114 throughout the home/structure, having access to the interior of the home/structure (Operation 2070).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, an apparatus and method for providing a selective fresh air source using existing ducting is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A fresh air system comprising:

a Central Ventilation and Control Board system (CVT CB);

an optional Wi-Fi wall switch;

a Central Ventilation and Software Application system (CVT App);

a fresh outside air low-profile fresh air roof vent or gable vent coupled to a flex duct;

the flex duct coupled to an optional dual position duct damper;

an optional actuator coupled to the optional duct damper;

the flex duct coupled to a round to rectangle duct collar;

the round to rectangle duct collar coupled to an optional ultraviolet (UV) light;

the round to rectangle duct collar coupled to a filter box;

the filter box coupled to a transition box with a dual position damper and actuator;

the dual position actuator coupled to the CVT CB or a Central Ventilation Wi-Fi Plug-n-Play plug adaptor (CVT Wi-Fi PNP);

a Carbon Monoxide (CO)/Refrigerant gas detector coupled to the CVT CB; and wherein the transition box with the dual position damper and actuator coupled between a new or existing Heating, Ventilating, and Air Conditioning (HVAC) supply plenum and a new or existing evaporative coil, the HVAC supply plenum coupled to a plurality of new or existing HVAC supply ducts, the plurality of HVAC supply ducts coupled to a plurality of new or existing ceiling supply vents within a structure, the plurality of ceiling supply vents having access to air inside of the structure.

2. The fresh air system of claim 1 including an optional actuator to move the optional duct damper from an inactive closed position to an active open position thereby allowing fresh air flow from the fresh outside low-profile roof air vent or gable vent through the flex duct, past the optional duct damper and optional actuator, through the flex duct, through the round to rectangle duct collar, past the optional UV light, through the filter box, past a flag, rolling, or other type of damper that can open or close in tandem with the optional actuator, the flag, rolling, or other type of damper closing off the evaporative coil enabling air to pass into the transition box, past the CO/Refrigerant gas detector into the HVAC supply plenum, and through the supply ducts and vents into the structure.

3. The fresh air system of claim 1 including a rolling actuator to move the transition box damper from an inactive closed position to an active open position thereby closing off the evaporative coil, and a furnace or air handler from the transition box and enabling air to pass through the supply plenum, supply ducts and existing vents in the structure.

4. The fresh air system of claim 1 including the dual position actuator to move the transition box damper from an inactive closed position to an active open position thereby closing off the evaporative coil, and a furnace or air handler from the transition box to the supply plenum enabling air to pass through the supply ducts and vents in the structure.

5. The fresh air system of claim 1 wherein the CVT CB controls operation of the dual position actuator, the optional Wi-Fi wall switch, the CVT App, safeties and logic, the CO/Refrigerant gas detector, and communication with a Central Ventilation and Whole House Fan system (CVT WHF), and a Central Ventilation and Filtered Free Cooling system (CVT FFC).

6. The fresh air system of claim 5 wherein the CVT CB communicates with the fresh air system independently or combined with the CVT WHF.

7. The fresh air system of claim 5 wherein the CVT CB communicates with the CVT WHF and its components.

8. The fresh air system of claim 5 wherein the CVT CB communicates with the CVT FFC and its components.

9. The fresh air system of claim 5 wherein the CVT App communicates with the CVT CB, the optional Wi-Fi wall switch, the CVT FFC, and the CVT Wi-Fi PNP.

10. The fresh air system of claim 5 wherein the CVT App is further configured to:

set up customer information/login and password;

set up devices connected to the CVT App;

communicate to the CVT Wi-Fi PNP;

establish a Wi-Fi connection to communicate to other Internet-of-Things (IoT) platforms, logic, or smart thermostats;

turn on/off the CVT WHF or whole house fan;

turn on/off the CVT FFC and or fresh air system;

turn on/off a whole house fan that is coupled to the CVT Wi-Fi PNP;

set up schedules, run times, or time zones;

configure the fresh air system and related locations;

control fan motor speed when connected to the CVT CB;

report or graph energy usage;

send prompts or alerts to a user based on weather, indoor and outdoor temperature differences, CO/Refrigerant gas detection, emergency services needed, or service technician needed; and set up other users with functionality restrictions.

11. A method comprising:

installing a Central Ventilation and Control Board system (CVT CB) control board on a Filtered Fresh Air System;

coupling an optional Wi-Fi wall switch;

coupling a Central Ventilation and Software Application system (CVT App) to a mobile device or personal computer (PC);

coupling a fresh outside air low-profile roof vent or gable vent on roof of structure to a large flex duct;

coupling the large flex duct to an optional duct damper and optional actuator;

coupling the optional actuator to the CVT CB;

coupling the optional duct damper to the large flex duct;

coupling the large flex duct to a round to rectangle sheet metal collar;

coupling an optional ultraviolet (UV) light within the round to rectangle sheet metal collar;

coupling the round to rectangle sheet metal collar to a filter box;

coupling the filter box to an "L" shaped or standard transition box that rests between a new or existing Heating, Ventilating, and Air Conditioning (HVAC) supply plenum and a new or existing evaporative coil;

coupling the damper and actuator within the transition box;

coupling the actuator to the CVT CB or a Central Ventilation Wi-Fi Plug-n-Play plug adaptor (CVT Wi-Fi PNP);

coupling a Carbon Monoxide (CO)/Refrigerant gas detector within the transition box;

coupling the CO/Refrigerant gas detector to the CVT CB; and coupling the transition box between the evaporative coil and the HVAC supply plenum via a plurality of output ducts and output vents routed throughout a structure, having access to an interior of the structure.

12. The method of claim 11 including installing the CVT CB to control operation of the actuator and operational safeties for the HVAC system and CO/Refrigerant gas detector, and the coupling to the optional Wi-Fi wall switch to a Central Ventilation and Filtered Free Cooling system (CVT FFC), and CVT App operations on the mobile device or PC.

13. The method of claim 11 including the CVT CB with CVT APP to integrate multiple brands, variable switches, and manual or smart thermostats.

14. The method of claim 11 including installing a rolling actuator or other damper actuator to move the plenum damper from an inactive "Off" closed position to an active "On" open position thereby closing off the HVAC evaporative coil, and HVAC furnace or air handler from the HVAC supply plenum.

15. The method of claim 11 including installing the optional duct damper and optional actuator to move the optional duct damper from an inactive "Off" closed position to an active "On" open position thereby allowing fresh air flow from the fresh outside low-profile roof air vent or gable vent to the HVAC supply plenum.

16. The method of claim 11 including installing the CVT App to command operation of a CVT CB, and multiple brands of variable switches, both manual and automatic.

17. The method of claim 11 including enabling the CVT App to command operation of multiple manual and automatic thermostats.

18. The method of claim 11 including operation of the CVT CB with the CVT App that integrates with a Central Ventilation and Whole House Fan system (CVT WHF) or whole house fan, and the fresh air system, and automatic and passive systems.

19. The method of claim 11 including operation of the CVT CB with CVT software logic that integrates controls for Internet-of-Things (IoT) ecosystems that apply.

20. The method of claim 11 including operation of the CVT CB with the CVT App that integrates controls for Internet-of-Things (IoT) ecosystems that apply.

21. The method of claim 11 including operation of the CVT App to control a Central Ventilation and Whole House Fan system (CVT WHF) or whole house fan systems, by manual operation or voice control through platform logic.

22. The method of claim 11 including operation of the CVT App that reads an indoor and outdoor temperature of the structure.

23. The method of claim 11 including operation of the CVT App that reads the CO/Refrigerant gas detector within the structure, and prompts the user with options whether or not to alert emergency services and/or call a service technician to assess the alert.

24. The method of claim 11 including operation of the CVT CB that integrates with the fresh air system with a Central Ventilation and Whole House Fan system (CVT WHF), the optional Wi-Fi wall switch, the CVT App, and a Central Ventilation and Filtered Free Cooling system (CVT FFC).

25. The method of claim 11 including operation of the CVT CB with the optional Wi-Fi wall switch and CVT App that integrates the HVAC system with a Central Ventilation and Whole House Fan system (CVT WHF) and the fresh air system.

26. The method of claim 11 including operation of the CVT CB with the CVT App that integrates Internet-of-Things (IoT) device logic providing IoT device management logic with access to one or more external IoT devices.

27. The method of claim 11 including operation of the CVT CB with the CVT App to command or access information generated by an external Internet-of-Things (IoT) device and to allow the user to control the external IoT devices.

28. The method of claim 11 including operation of the CVT CB with the CVT App that integrates technology wirelessly or hardwired to a smart room thermostat, a Wi-Fi wall switch, a CO/Refrigerant gas detector, and a building HVAC system.

29. The method of claim 11 including operation of the CVT CB with the CVT App that includes electronic communication with other devices by an Internet-of-Things (IoT) device, so that a building operator can determine outside building temperatures are cooler than inside building temperatures and enabling the building operator to deactivate the HVAC operation and energize or activate a Central Ventilation and Whole House Fan system (CVT WHF) and the fresh air system.

30. The method of claim 11, including operations of the CVT Wi-Fi PNP with the CVT App that includes monitoring operational safeties for the HVAC system, and generation of energy usage reports, run time schedules and user settings.

* * * * *